United States Patent [19]

Jennings

[11] Patent Number: 4,825,471

[45] Date of Patent: May 2, 1989

[54] GARMENT USEFUL FOR LISTENING TO AUDIO SIGNALS

[75] Inventor: Oliver Jennings, Saint John De La Salle Parish, 10205 Dr. Martin Luther King Dr., Chicago, Ill. 66028

[73] Assignee: Oliver Jennings, Chicago, Ill.

[21] Appl. No.: 67,961

[22] Filed: Jun. 29, 1987

[51] Int. Cl.[4] ..... A41B 1/00

[52] U.S. Cl. ..... 2/94; 2/115; 2/247; D 2/184; D 2/209

[58] Field of Search ..... 2/77, 94, 106, 115, 2/247, DIG. 6; D2/183, 184, 187, 191, 208, 209

[56] References Cited

U.S. PATENT DOCUMENTS

| | | | |
|---|---|---|---|
| 1,088,891 | 3/1914 | Filson | 2/115 |
| 2,688,752 | 9/1954 | Sbarra et al. | 2/247 X |
| 3,665,517 | 5/1972 | Hyman | 2/94 X |
| 3,911,500 | 10/1975 | Navmovski | 2/115 |
| 4,451,935 | 6/1984 | Henschel | 2/247 V |

*Primary Examiner*—David Werner

*Attorney, Agent, or Firm*—Frank J. Uxa, Jr.

[57] ABSTRACT

A garment to be worn on the upper torso of a human comprises:

a shirt adapted and sized to fit on the upper torso of a human, the shirt having a front side and a back side, and a head opening for the head of the human;

right and left sleeves associated with the shirt, and adapted and sized to receive the right and left arms, respectively, of the human;

a front pocket secured to the front side of the shirt and adapated and sized to receive and hold an audio device for producing audio signals; and right and left sleeve pockets secured to the right and left sleeves, respectively and each being adapted and sized to receive and hold an audio speaker device.

10 Claims, 1 Drawing Sheet

GARMENT USEFUL FOR LISTENING TO AUDIO SIGNALS

This invention relates to a garment to be worn by a human which facilitates listening to audio signals, e.g., entertainment, information and the like. More particularly, the invention relates to such a garment which facilitates listening to audio signals without requiring the use of earphones or earplugs and allowing the human wearing the garment to keep his/her hands free for other activities.

Listening to audio signals, e.g., music, other entertainment, information and the like, can be a very pleasurable, and even educational activity. It may also help make strenuous and difficult exercise or work more tolerable. For example, joggers are often seen with earphones plugged in listening to radio or cassette players to make their jogging more fun. One problem with the use of earphones during strenuous activities, such as jogging, is that the jogger's perspiration makes wearing such earphones uncomfortable. Also, the earphones themselves may interfere with the activity, e.g., jogging, being engaged in. Moreover, the quality of the sound obtained by using the earphones may leave something to be desired. Also, there is some question about the long term health effects of using such earphones. The alternative of carrying a large audio device with you is really unworkable since it would clearly interfere with the primary activity, e.g., jogging. Clearly, a new system to facilitate listening to audio signals, e.g., while engaged in strenuous physical activity, would be advantageous.

In preparing the application, the following U.S. Patents were considered: U.S. Pat. Nos. 4,637,075; 4,539,700; 4,084,139; 3,193,842; 2,841,794; and 2,134,425.

Such a system to facilitate listening to audio signals has been discovered. In one broad aspect, the system involves a garment to be worn on the upper torso of a human which comprises shirt means, right and left sleeve means, front pocket means and right and left sleeve pocket means. The shirt means is adapted and sized to fit on, e.g., over, the upper torso of a human and has front and opposing back sides and a head opening for the head of the human. The right and left sleeve means are associated with the shirt means, and are adapted and sized to receive the right and left arms, respectively of the human. The front pocket means is secured to the front side of the shirt means and is adapted and sized to receive and hold a first audio device for producing audio signals, e.g., a radio, tape cassette player and the like. The right and left sleeve pocket means are secured to the right and left sleeve means, respectively. Each of these sleeve pocket means is adapted and sized to receive and hold an audio speaker device, e.g., which is associated with the first audio device in the front pocket means.

The present system provides substantial advantages. For example, the human wearing this garment can enjoy the audio entertainment or information from the audio device without holding the audio device and without using annoying earphones. His/her hands remain free to engage in whatever activity, e.g., strenuous physical activity, he/she desires. Since speakers are located on both the right and the left side of the human, quality stereo audio reception is obtainable. Placing the speakers on the sleeves of the garment, rather than on or in the shirt means (covering the human's torso), has been found to provide for sufficient speaker separation such that high quality stereo sound is obtained. With the speaker devices located on the sleeves covering the upper arms of the human not only is good audio sound provided, but also the speakers have little or no adverse impact on the human's activities, and the human's arms are left substantially completely free to engage in other activities. Also, the audio device and the speaker devices are conveniently and readily accessible, e.g., to replace an audio tape, to increase the volume of the signal, to change radio stations and the like. In short, the present system is very convenient and easy to use, and enhances the human's enjoyment of audio signals without interfering with other activities.

The front pocket means and each of the sleeve pocket means is preferably structured to be opened and closed, as desired. In one particularly useful embodiment, the front pocket means includes a front flap and the right and left sleeve pocket means includes a right sleeve flap and a left sleeve flap, respectively. Each of these flaps can be independently, manually manipulated to open and close its associated pocket, as desired. Such opening and closing aids the pockets means in receiving and holding the audio devices and speaker devices, as described herein. Each of the front pocket means and the right and left sleeve pocket means preferably includes a separate hook and loop fastening means, e.g., corresponding or mating strips of Velcro hooks and Velcro loops, to facilitate the opening and closing of the individual pocket means. The use of such hook and loop fastening means provides adequate closing of the pocket means, and also allows lead wires to be connected between the audio and speaker devices to provide required electrical/audio communincation between these devices.

In one embodiment, the garment of the present invention further comprises harness means which is structured to be removably associated with the shirt means, and pouch means secured to the harness means. The pouch means is adapted and sized to receive and hold a second audio device for producing audio signals, e.g., a compact disc player and the like. The pouch means is preferably sized to receive and hold an audio device which is larger than that which can be received and held by the front pocket means. This harness/pouch modification of the present system allows the use of a different size audio device in combination with speaker devices located in the left and right sleeve pocket means. Alternately, the harness means and, the pouch means may be used in combination with a garment which does not include a front pocket means. Although this embodiment is included within the scope of the present invention, it is preferred that the present garment include front pocket means, and left and right sleeve pocket means each of which is substantially permanently secured to the present shirt means.

The present harness means preferably includes right and left straps each of which is associated with both the front side and the back side of the shirt means when the harness means is associated with the shirt means.

The shirt means itself preferably includes a right loop and a left loop, more preferably, situated at or near the top of the shirt means near the head opening. These loops are structured so that one or more straps can be passed through them, as desired. For example, the left loop can have the left strap of the harness means passed through it, and the right loop can have the right strap of the harness means passed through it. Using these loops in combination with the straps of the harness means allows the harness means to be more securely set in place on the shirt means.

These and other aspects and advantages of the present invention are set forth in the following detailed description and claims particularly when considered in conjunction with the accompanying drawings in which like parts bear like reference numerals. In the drawings:

Figure 2:
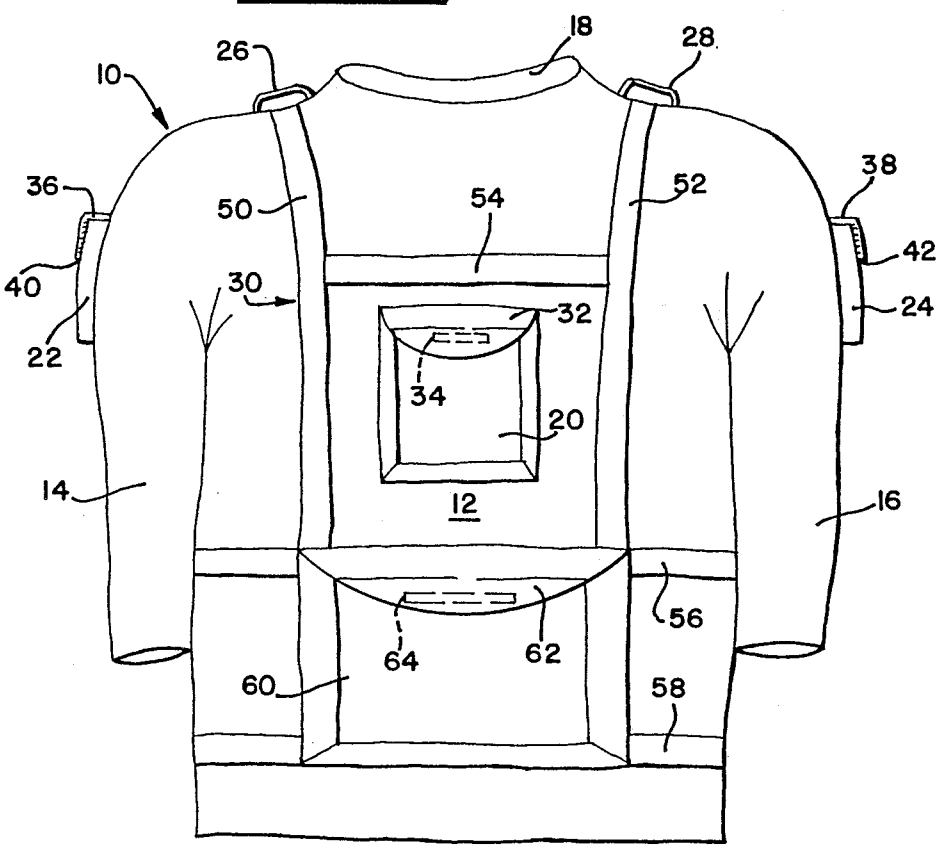
FIG. 2 is a front plan view of the embodiment shown in FIG. 1.

Referring now to the drawings, a shirt-like garment, shown generally at 10, includes a shirt body 12, a right sleeve 14, a left sleeve 16, a head opening 18, a front pocket 20, a right sleeve pocket 22 and a left sleeve pocket 24. Also included are a right top loop 26, a left top loop 28 and a harness system, shown generally at 30.

Hanging over the top of front pocket 20 is a front flap 32 which can be manually manipulated to open and close front pocket 20. Shown in shadow lines is a front hook/loop fastener 34 which is associated with both front pocket 20 and front flap 32. The hooks and loops of front fastener 34 can be engaged or disengaged to close or open front pocket 20, as desired.

Hanging over the tops of right sleeve pocket 22 and left sleeve pocket 24 are a right flap 36 and a left flap 38, respectively, which can be manually manipulated to open and close right sleeve pocket 22 and left sleeve pocket 24, respectively. A right hook/loop fastener 40 and a left hook/loop fastener 42 is associated with both right sleeve pocket 24-right flap 36 and left sleeve pocket 24-left flap 38, respectively. The hooks and loops of right fastener 40 and left fastener 42 can be independently engaged or disengaged to close or open right sleeve pocket 22 and left sleeve pocket 24, respectively, as desired.

Harness 30 inludes a right vertical strap 50, a left vertical strap 52, a connector strap 54, a top horizontal strap 56 and a bottom horizontal strap 58. Permanently secured, e.g., sewed, to straps 50, 52, 56 and 58 is a pouch 60, which is larger than front pocket 20. Hanging from the top of pouch 60 is a flap 62 which can be manually manipulated to open and close pouch 60. Shown in shadow lines is a pouch hook and loop fastener 64 which is associated with both pouch 60 and pouch flap 62. The hooks and loops of pouch fastener 64 can be engaged or disengaged to close or open pouch 60 as desired.

Harness 30 is positioned for use by placing top and bottom horizontal straps 56 and 58 around the upper torso of the human using garment 10. Right vertical strap 50 and left vertical strap 52 are then placed through right loop 26 and left loop 28, respectively, and secured to the back sides of top horizontal strap 56.

Front pocket 20 is permanently secured, e.g., sewed to shirt body 12 and right sleeve pocket 22 and left sleeve pocket 24 are permanently secured, e.g., sewed, to right sleeve 14 and left sleeve 16, respectively.

Figure 1:
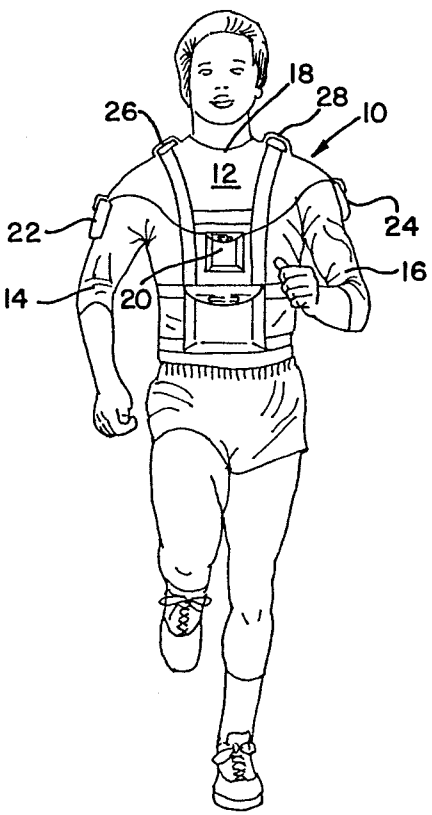
FIG. 1 is a front view showing an embodiment of the present system in use.

Garment 10 functions as follows: A human wishing to listen to audio which engaging in other activities, e.g., jogging, puts garment 10 on his upper torso, as illustrated in FIG. 1. Front flap 32 is opened and a radio is placed in front pocket 20. Right and left flaps 36 and 38 are opened and conventional miniaturized speakers are placed in right sleeve pocket 22 and left sleeve pocket 24. Wires are attached to the radio and speakers to provide the required audio/electrical communication between these devices. Front flap 32, and right and left flaps 36 and 38 are then closed. With the radio turned on and tuned in as desired, stereo sound is provided from the speakers located in right and left sleeve pocket 22 and 24.

Pouch 60 can be used in much the same way to recevie and hold an audio device, preferably a relatively large device, e.g., a compact disc player, which is too big to fit in front pocket 20.

In any event, garment 10 provides quality stereo sound without requiring the use of earphones or earplugs while allowing the human wearing garment 10 to engage in strenuous physical activity without interference from the audio device or the speaker devices.

While this invention has been described with respect to various specific examples and embodiments, it is to be understood that the invention is not limited thereto and that it can be variously practiced within the scope of the following claims.

What is claimed is:

1. A garment to be worn on the upper torso of a human comprising:

shirt means adapted and sized to fit on the upper torso of a human, said shirt means having a front side and opposing back side and a head opening for the head of said human;

right and left sleeve means associated with said shirt means, and adapted and sized to receive the right and left arms, respectively, of said human;

front pocket means secured to said front side of said shirt means and adapted and sized to receive and hold a first audio device for producing audio signals;

right and left sleeve pocket means secured to said right and left sleeve means, respectively, each of said sleeve pocket means being adapted and sized to receive and hold an audio speaker device;

a right loop and a left loop each of which being situated at or near the top of said shirt means near said head opening and through each of which one or more straps can be passed;

harness means structured to be removably associated with said shirt means and including right and left straps which are passed through said right and left loops, respectively; and pouch means secured to said harness means, located below said front pocket means relative to said head opening and adapted and sized to receive and hold a second audio device for producing audio signals.

2. The garment of claim 1 wherein each of said front pocket means and said right and left sleeve pocket means is structured to be opened and closed, as desired.

3. The garment of claim 2 wherein said front pocket means includes a front flap which can be manually manipulated to open and close said front pocket means as desired, and said right and left sleeve pocket means include a right sleeve flap and a left sleeve flap, respectively, which can be manually manipulated to open and close said right sleeve pocket means and said left sleeve pocket means, respectively, as desired.

4. The garment of claim 2 wherein each of said front pocket means and said right and left sleeve pocket means includes a separate hook and loop fastening means to facilitate said opening and said closing, as desired.

5. The garment of claim 3 wherein each of said front pocket means and said right and left sleeve pocket means includes a separate hook and loop fastening means to facilitate said opening and said closing, as desired.

6. The garment of claim 1 wherein said pouch means is structured to be opened and closed, as desired.

7. The garment of claim 6 wherein said pouch means included a pouch flap which can be manually manipulated to open and close said pouch means, as desired.

8. The garment of claim 6 wherein said pouch means includes a hook and loop fastening means to facilitate said opening and said closing, as desired.

9. The garment of claim 7 wherein said pouch means includes a hook and loop fastening means to facilitate said opening and said closing, as desired.

10. The garment of claim 1 wherein said pouch means is sized to receive and hold an audio device which is larger than can be received and held by said front pocket means.

* * * * *